US006890146B2

(12) United States Patent
Blumenthal et al.

(10) Patent No.: US 6,890,146 B2
(45) Date of Patent: May 10, 2005

(54) COMPOUND FRICTION VACUUM PUMP

(75) Inventors: Roland Blumenthal, Cham (CH); Stephan Hundertmark, Lohmar (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/380,988

(22) PCT Filed: Aug. 9, 2001

(86) PCT No.: PCT/EP01/09194

§ 371 (c)(1),
(2), (4) Date: Aug. 28, 2003

(87) PCT Pub. No.: WO02/27189

PCT Pub. Date: Apr. 4, 2002

(65) Prior Publication Data

US 2004/0033130 A1 Feb. 19, 2004

(30) Foreign Application Priority Data

Sep. 21, 2000 (DE) ..... 100 46 766

(51) Int. Cl.[7] ..... F01D 1/36
(52) U.S. Cl. ..... 415/90; 415/143
(58) Field of Search ..... 415/90, 143, 199.1–199.5, 415/912

(56) References Cited

U.S. PATENT DOCUMENTS

| | | | | |
|---|---|---|---|---|
| 3,969,039 A | | 7/1976 | Shoulders | 417/244 |
| 5,052,887 A | | 10/1991 | Novikov et al. | 415/90 |
| 5,358,373 A | * | 10/1994 | Hablanian | 415/90 |
| 5,553,998 A | | 9/1996 | Muhlhoff et al. | 415/90 |
| 5,695,316 A | | 12/1997 | Schutz et al. | 415/90 |
| 6,168,374 B1 | | 1/2001 | Stolle et al. | 415/90 |
| 6,334,754 B1 | * | 1/2002 | Kabasawa | 415/90 |
| 6,422,829 B1 | | 7/2002 | Schutz | 417/203 |

FOREIGN PATENT DOCUMENTS

| | | |
|---|---|---|
| DE | 19632874 | 2/1998 |
| EP | 442 556 A1 | 8/1991 |
| EP | 692 636 A1 | 1/1996 |
| WO | WO 99 15793 | 4/1999 |

* cited by examiner

*Primary Examiner*—Edward K. Look
*Assistant Examiner*—James M. McAleenan
(74) *Attorney, Agent, or Firm*—Fay, Sharpe, Fagan, Minnich & McKee, LLP

(57) ABSTRACT

A friction vacuum pump (1) has at least one turbomolecular pump stage (6, 7) with a molecular pump stage (12, 13, 15) that is subsequently connected on the pressure side (3), and with a transition stage (23) mounted between the turbomolecular pump stage and the molecular pump stage. In order to improve the transition from the turbomolecular zone to the molecular zone, the transition stage has a flow section that is continuously tapered in the tangential by limiting surfaces (27, 28).

7 Claims, 2 Drawing Sheets

COMPOUND FRICTION VACUUM PUMP

BACKGROUND OF THE INVENTION

The present invention relates to a friction vacuum pump comprising at least one turbomolecular pump stage, with a molecular pump stage that is subsequently connected on the pressure side, and with a transition stage mounted between the turbomolecular pump stage and the molecular pump stage.

In turbomolecular pumps with molecular pump stages, commonly designed as screw pump stages, subsequently connected on the pressure side, also called compound pumps, there exists the problem of a changing flow characteristic in the pumped gases in the transition area from molecular (at pressures below $10^{-3}$ mbar) to laminar (from about $10^{-2}$ mbar upwards). As the pumped gas changes from the turbomolecular stage into the screw stage, the pumped gas needs to be deflected from a primarily tangential direction of flow to a primarily axial direction of flow. The radial dimension of the flow channel is tapered considerably. Across a very short distance, a large change in the axial cross section of the pump chamber needs to be implemented. Known embodiments of this transition area have the disadvantage of incurring losses in the flow. These impair to a considerable extent the pumping capacity of the pump.

From DE 297 17 079 a friction vacuum pump having the aforementioned characteristics is known. Part of the transition stage is a centrifugal pump formed by ridges on the rotor side extending substantially in the radial direction. This solution does in fact have the effect of deflecting the gases into the screw stage; however, its pumping effect is limited. Moreover, the known solution requires that the diameter of the screw pump stage be greater than the diameter of the turbomolecular stage. For this reason it is not usable in high pumping capacity friction pumps, since the diameter of the rotor in the molecular pump stage is subject to restrictions in size owing to the high centrifugal forces. Finally as to the arrangement of the ridges on the rotor side it holds that their manufacture is involved and that they are not uncritical as to material tensions.

The content of U.S. Pat. No. 6,168,374, moreover, belongs to the state-of-the-art. From this it is known to provide between the turbomolecular pump stage and the molecular pump stage that is subsequently connected, a filling stage which is equipped with wings. Also this solution is difficult to manufacture. Moreover, there result during operation, high mechanical tensions in the area of the wings bases.

It is the task of the present invention to create a vacuum engineering wise optimised transition of the turbomolecular range to the molecular range without suffering the disadvantages detailed.

SUMMARY OF THE INVENTION

In accordance with one aspect of the present invention, the transition stage is part of the stator and said transition stage has a flow section extending substantially in the tangential direction which is tapered continuously in the direction of the flow.

By shifting the transition stage into the stator, the objective is attained in that its design is free of material-related problems which would be observed when arranging the transition stage on the side of the rotor due to the occurring centrifugal forces.

The present solution also takes in to account that the velocity of the flowing gases in the transition range is significantly greater in the tangential direction compared to the axial direction (a factor between 10 and 30). For the avoidance of sudden changes in the flow section, it is for this reckon expedient to implement a tapered section extending substantially in the tangential direction resulting in a low gradient taper. The gradient depends on the number of blades in the transition stage as well as on the ratio between blade length and diameter of the downstream screw stage. The number of blades in the transition stage is determined on the basis of the same criteria which apply to the upstream turbomolecular stages.

Thus an increase in pumping capacity is attained. Flow losses are thus reduced.

If the flow apertures designed in accordance with the present invention are accommodated in a stator ring disk, then said apertures can be manufactured in a simple manner by milling.

In the milling process, the cost-effective method of "spot facing" may be employed, specifically with a cylindrical tool, provided the blades which limit the flow section do not overlap. Should the blades overlap, manufacture can be effected by means of a milling cutter having on its face side an increased diameter.

Further advantages and details of the present invention shall be explained with reference to the examples of embodiments depicted schematically in drawing FIGS. 1 to 7.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
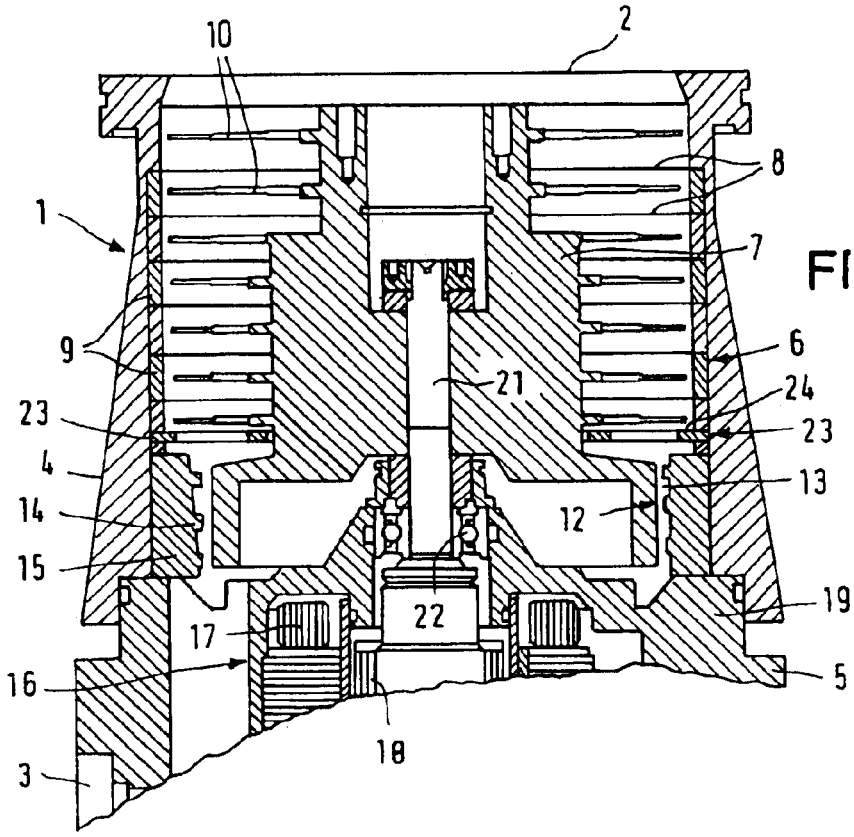
FIG. 1 is a sectional view through a compound pump in accordance with the present invention.

In the example of an embodiment in accordance with drawing FIG. 1 the pump itself is designated as 1, its inlet as 2 its exhaust as 3. The housing of the pump 1 comprises the two sections 4 and 5.

The housing section 4 encompasses the stator 6 and the rotor 7 of the turbomolecular pump stage. The stator 6 comprises schematically indicated blade half rings 8 as well as spacing rings 9 which together form a self-centering stator pack. The rotor 7 is equipped with the rotor blades 10. Only the stator half rings, the blades of which together with the last row of rotor blades 10 on the pressure side form the last turbomolecular pump stage on the pressure side, are depicted with more detail and are designated as 23. Depicted in drawing FIG. 2 is a perspective view of one of these stator half rings 23.

The housing section 4 also encompasses the stator 15 and the rotor 12 of the screw or molecular pump stage, the pump chamber are defined by a pumping slit is designated as 13. The thread 14 of this stage may be arranged on the stator or the rotor side. In the instance of the depicted example of an embodiment its is arranged on the stator side and part of a stator sleeve 15, fitted independently of housing section 4. The rotor 7 of the turbomolecular pump stage 7, 8 and the rotor 12 of the screw pump stage 11, 12 are parts of a jointly rotating system 7, 12. The rotor 12 of the screw pump stage forms the end of this system on the pressure side and may be designed as a disk or be bell shaped (as depicted in FIG. 1).

The housing section 5 encompasses the drive motor 16, the stator of which is designated as 17 and its rotor is designated as 18. The housing section 5 is part of a chassis 19 with an internal chamber in which the drive motor 16 and further components are located. Also accommodated in the chassis 19 is the shaft 21 of the compound pump said shaft carrying the rotors 7 and 12. Only the upper bearing 22 is visible. It is a mechanical bearing, which may also be replaced by a magnetic bearing. Moreover, the chassis 19 is the carrier for all further components of the pump 1.

Figure 2:
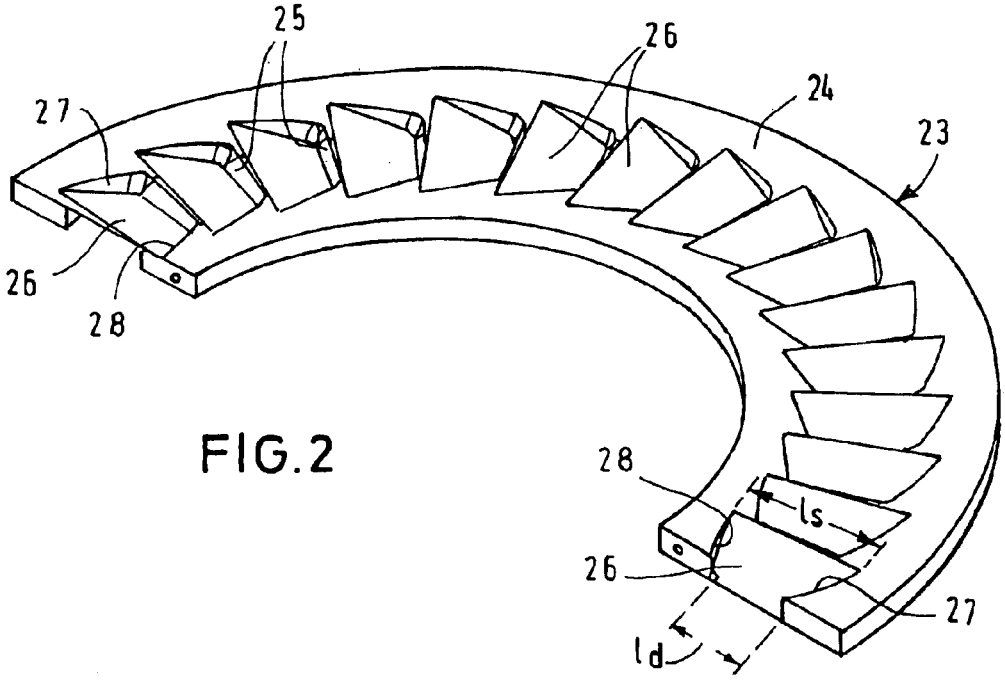
FIG. 2 is a perspective view of a stator half ring designed in accordance with the present invention.

The stator half ring 23 depicted schematically in drawing FIG. 2 consists of a half ring disk 24 with a multitude of flow apertures 25 spread along its circumference. These are formed by blade sections 26 which extend substantially radially and are preferably manufactured by milling. The flow apertures 25 are designed in such a manner that there, in all, results a flow section extending substantially in the tangential direction and continuously tapered in the direction of the flow. This is attained by the length of the blade sections 26 (their radial extension) being greater on the intake side (Is) compared to the pressure side (Id), i.e. that the distance of the lateral limiting surfaces 27, 28 of the flow apertures 25 decreases with respect to the direction of the flow.

Figure 3:
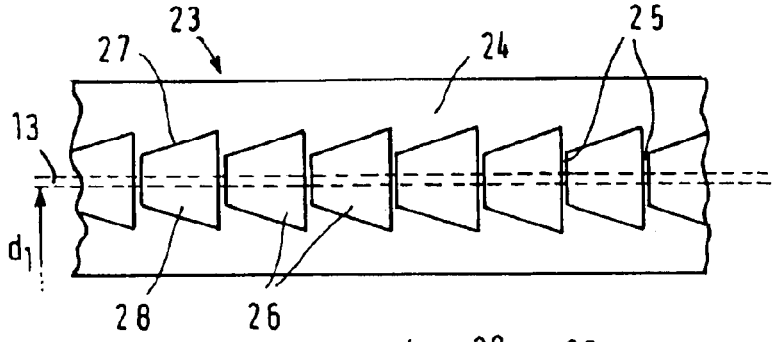
FIG. 3 is a top view on to a section of a stator half ring depicted by way of a developed view.
Figure 4:
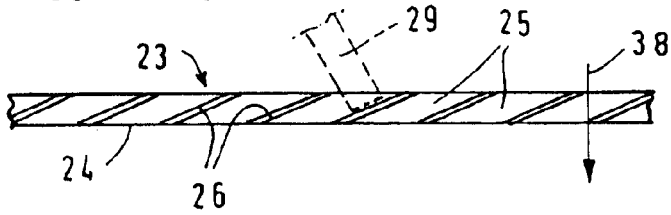
FIG. 4 is a sectional view through a the stator half ring in accordance with FIG. 3, FIGS. 5 and 6 are top views on to further embodiments (developed views)

Drawing FIGS. 2, 3 and 4, depict embodiments of a stator half ring 23 in which the blade sections 26 do not overlap. They allow viewing on to the half ring disk 23 in the axial direction (indicated by the arrow 38 in drawing FIG. 4). In the instance of stator half rings of this kind, the blade sections may be manufactured through "spot facing" with a cylindrically designed tool 29 (see FIG. 4).

Figure 5:
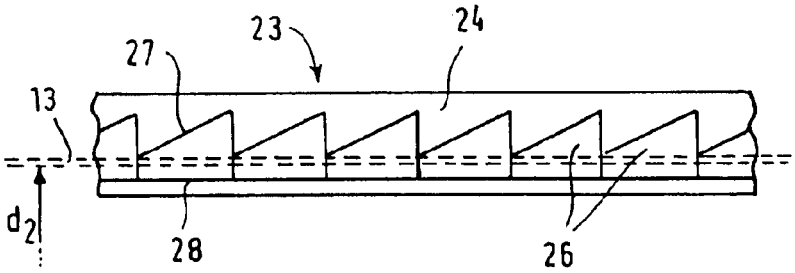
Figure 6:
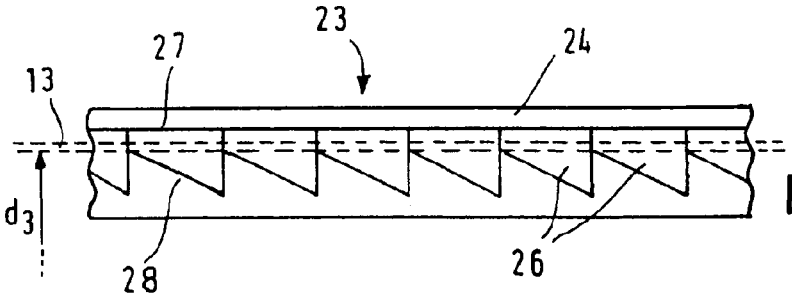
Figure 7:
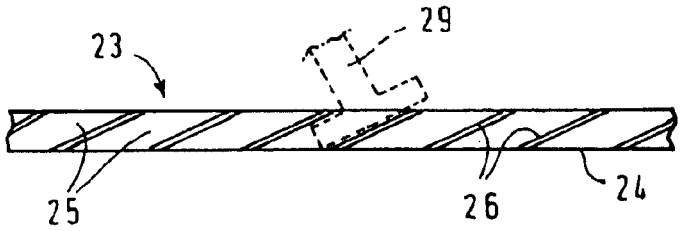
FIG. 7 is a sectional view through a the stator half ring in accordance with FIG. 6.

In the embodiments in accordance with FIGS. 5 to 7, the blade sections 26 overlap which respect to each other. Also these embodiments allow manufacturing of the stator half rings by milling. Here, the tool 29 has an increased diameter at its face side (see FIG. 7).

In drawing FIGS. 3, 5 and 6, the pumping slot 13 of the screw stage 12, 15 located downstream of the turbo stages is indicated by dashed lines in each instance. In these embodiments the pumping slots 13 differ in diameter $d_1$, $d_2$, $d_3$. The flow apertures 25 designed in accordance with the present invention allow an adaptation to different diameters for the pumping slot 13. This may be effected in that the position of the limiting surfaces 27, 28 and specifically their inclination with respect to the respective tangents is selected such that the pumping slot 13 is located approximately in the middle of the radial extensions Id of the blade sections 26 on their pressure side.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A friction vacuum pump comprising:

at least one turbomolecular pump stage;

a molecular pump stage connected on a pressure side of the turbomolecular stage; and a transition stage mounted between the turbomolecular pump stage and the molecular pump stage, the transition stage being formed by the last row of stator blades arranged on the pressure side, the transition stage having a flow section that is continuously tapered in a tangential direction.

2. The pump according to claim 1, wherein the stator blades are parts of a stator ring disk having two half rings and each half ring having limiting flow apertures continuously tapered in the tangential direction.

3. The pump according to claim 2, wherein lateral limiting surfaces of blades limit the flow apertures a distance between the lateral limiting surfaces decreasing in the direction of the flow.

4. The pump according to claim 3, wherein the decrease in the distance of the limiting surfaces is so designed that a pumping slot of the molecular pump stage downstream of the turbomolecular stage is located approximately at the middle of radial widths of the blades on their pressure side.

5. The pump according to claim 1, wherein the blades of the transition stage are manufactured by milling or casting.

6. A vacuum pump comprising:

a turbomolecular stage having a suction end and a pressure end;

a transition stator ring at the pressure end, the stator ring having a plurality of angled slots which direct flow from a primarily tangential direction to a primarily axial direction, the slots being larger at a turbomolecular stage side than at an output side;

a screw pump stage connected with the output side of the transition stator ring.

7. A vacuum pump comprising:

a turbomolecular stage having a suction end and a pressure end;

a downstream pump stage downstream from the turbomolecular stage;

a transition stator ring at the turbomolecular stage pressure end, the stator ring having a plurality of angled slots which direct flow from a primarily tangential direction to a primarily axial direction, the slots being defined on radial edges by limiting surfaces which converge from the turbomolecular stage toward the screw pump stage.

* * * * *